US005575444A

United States Patent [19]

Otema

[11] Patent Number: 5,575,444

[45] Date of Patent: Nov. 19, 1996

[54] ADJUSTABLE SHELF BRACKET

[76] Inventor: Martin Otema, 15 Pine Ridge Dr., Scarborough, Ontario, Canada, M1M 2X4

[21] Appl. No.: 405,160

[22] Filed: Mar. 16, 1995

[51] Int. Cl.[6] ..... A47G 29/02

[52] U.S. Cl. ..... 248/242; 248/250; 108/108

[58] Field of Search ..... 248/250, 235, 248/240, 241, 242, 257, 265; 108/108

[56] References Cited

U.S. PATENT DOCUMENTS

| | | | |
|---|---|---|---|
| D. 294,221 | 2/1988 | Sheftel | 248/242 X |
| 945,280 | 1/1910 | Lindberg | 248/242 |
| 3,114,531 | 12/1963 | Weber | 248/242 |
| 3,463,433 | 8/1989 | Stein et al. | 248/242 |
| 3,550,891 | 12/1970 | Scott | 248/242 |
| 3,561,713 | 2/1971 | Berkowitz | 248/242 |
| 3,572,626 | 3/1971 | Bertschi | 248/242 |
| 3,729,161 | 4/1973 | Christensen | 248/242 |
| 5,452,875 | 9/1995 | Kern | 248/250 X |
| 5,456,345 | 10/1995 | Sweeney | 248/250 |

FOREIGN PATENT DOCUMENTS

| | | | |
|---|---|---|---|
| 173005 | 12/1921 | United Kingdom | 248/241 |
| 279992 | 11/1927 | United Kingdom . | |
| 740311 | 11/1955 | United Kingdom . | |
| 1264935 | 4/1972 | United Kingdom . | |

*Primary Examiner*—Ramon O. Ramirez
*Attorney, Agent, or Firm*—Mark B. Eisen

[57] ABSTRACT

The invention provides an adjustable shelf bracket having means for making fine adjustments in the attitude of the bracket relative to the supporting surface, which allows the shelf to be levelled both longitudinally and transversely, and substantially facilitates alignment with adjacent shelves. In one embodiment this is accomplished by pivotally suspending a shelf clip from a vertical mounting gusset designed to be hung on the supporting surface, such that the attitude of the clip relative to the supporting surface can be adjusted. Adjusting means such as an adjusting screw engaged in a hole tapped through the clip bears against the mounting gusset to limit the travel of the clip under the weight of the shelf. The position of the adjusting screw thus determines the attitude of the portion of the shelf being supported by the clip.

20 Claims, 4 Drawing Sheets

ADJUSTABLE SHELF BRACKET

This invention relates to shelf supports. In particular, this invention relates to an adjustable shelf bracket for supporting shelves in a display stand, wall shelving system, bookcase, storage shelves or the like.

BACKGROUND OF THE INVENTION

Display stands, showcases, vitrines and shelving systems come in a variety of configurations and styles. Depending upon the nature of the articles to be displayed, many utilize sections of shelves affixed to a supporting wall or pedestal. By far the most common shelf support used in these types of displays is the slotted standard, which is essentially a metal channel with a column of vertical slots. Various shapes and styles of shelf bracket are designed to fit these standards, each bracket being provided with one, two or three barbed or hooked flanges spaced to fit into the slots in the standard. An example is illustrated in FIG. 4.

While the slotted standard provides a certain degree of versatility in the height at which the shelves can be mounted, it is impossible to make fine adjustments to the attitude or alignment of the shelves. Even if the slotted standard could be made and hung with a high degree of precision, it would be virtually impossible to ensure that shelves are mounted perfectly level or completely aligned. Many display units used today are primarily designed with aesthetic considerations in mind, and where the shelves cannot be properly levelled, or properly aligned with adjacent shelves, the effect sought to be created can be substantially diminished or become seriously disturbing visually.

For cantilevered shelf support brackets, particularly in the case of glass shelves where resilient pads are interposed between the bracket and the shelf to prevent chipping and scratching, it is simply not possible to anticipate the attitude that the mounted shelf will assume under its own weight. This problem becomes more acute as the depth of the bracket decreases relative to the depth of the shelf and the shelf becomes correspondingly more cantilevered. Because much of the aesthetic appeal in a display can be attributed to the absence of visible hardware, there is a clear preference in decorative displays toward the use of smaller shelf brackets, which are inconspicuous and more readily concealed. This results in an attendant decrease in the accuracy with which the shelves can be mounted.

Moreover, conventional shelf brackets of this type are designed to be mounted on slotted standards which are affixed vertically. The shelves mount to the standard at right angles to be supported horizontally. Where the surface upon which the standard is to be hung is not vertical, the shelves will not be properly level and custom made brackets designed specifically for the angle of the supporting surface must be used.

Examples of some decorative displays are illustrated in FIGS. 1 to 3. FIG. 1 illustrates an four-sided display unit with separate shelves mounted in each quadrant of the display. The shelves of each quadrant must not only be substantially level, but must be properly aligned with the shelves on either side in order to provide the intended visual appeal. Similarly, FIG. 2 illustrates a multiple-shelf display unit in which the shelves can be mounted back-to-back on a transparent support wall made of glass or acrylic. If the shelves are not mounted exactly level the misalignment becomes very pronounced when viewed through the transparent support wall. FIG. 3 illustrates a display unit with an oblique support wall. A conventional shelf bracket is wholly unsuitable for this unit, because the slotted standards are not oriented vertically and the shelf will therefore not be suspended horizontally.

SUMMARY OF THE INVENTION

This invention overcomes these disadvantages by providing an adjustable shelf bracket which fits a conventional slotted standard, having means for making fine adjustments in the attitude of the bracket relative to the standard. This allows the shelf to be levelled both longitudinally and transversely, and substantially facilitates alignment with adjacent shelves at a true horizontal level.

The invention accomplishes this by pivotally suspending a shelf clip from a mounting gusset designed to be hung on the standard, such that the attitude of the clip relative to the standard can be adjusted. Adjusting means, such as an adjusting screw engaged in a hole tapped through the clip, bears against the mounting gusset to limit the travel of the clip under the weight of the shelf. The position of the adjusting screw thus determines the attitude of the portion of the shelf being supported by the clip. The arc of travel of the clip about the mounting gusset can be made sufficiently large that a shelf can be levelled even when mounted on an oblique surface, so the clip of the invention can be used even where the supporting surface is not vertical. The invention can also be easily applied to support means other than a slotted standard, such as a base plate provided with any structure capable of being mounted on the supporting surface.

The invention thus provides a bracket for supporting a shelf comprising mounting means for mounting the bracket on a supporting surface, means for supporting a shelf, pivotally suspended from the mounting means such that the means for supporting a shelf can pivot toward and away from the supporting surface, and adjusting means for maintaining the means for supporting a shelf at a desired attitude relative to the supporting surface.

The invention further provides a shelf bracket comprising mounting means comprising a vertical mounting gusset, means for supporting a shelf pivotally suspended from the mounting gusset, and adjusting means for adjusting the attitude of the means for supporting a shelf comprising adjustable means bearing against the mounting gusset to define a lower limit of an arc of travel of the means for supporting a shelf.

BRIEF DESCRIPTION OF THE DRAWINGS

In drawings which illustrate a preferred embodiment of the invention by way of example only.

DETAILED DESCRIPTION OF THE INVENTION

Figure 3:
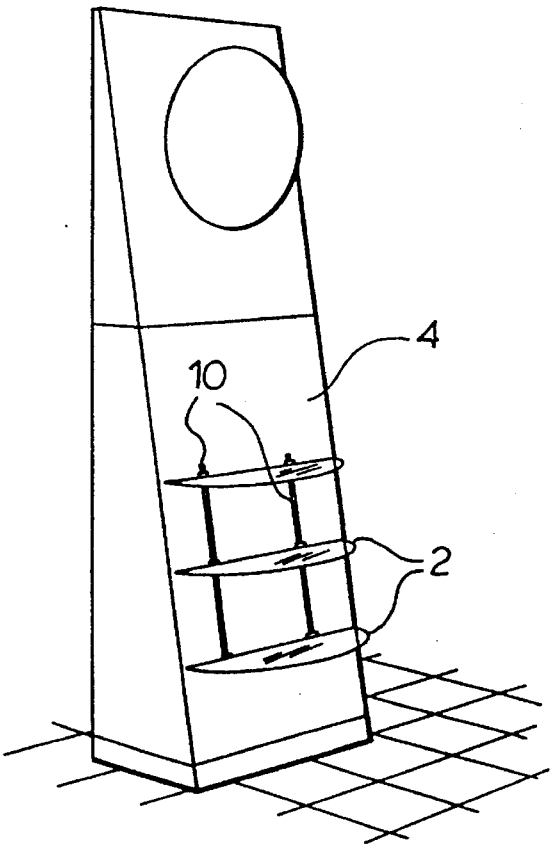
Figure 4:
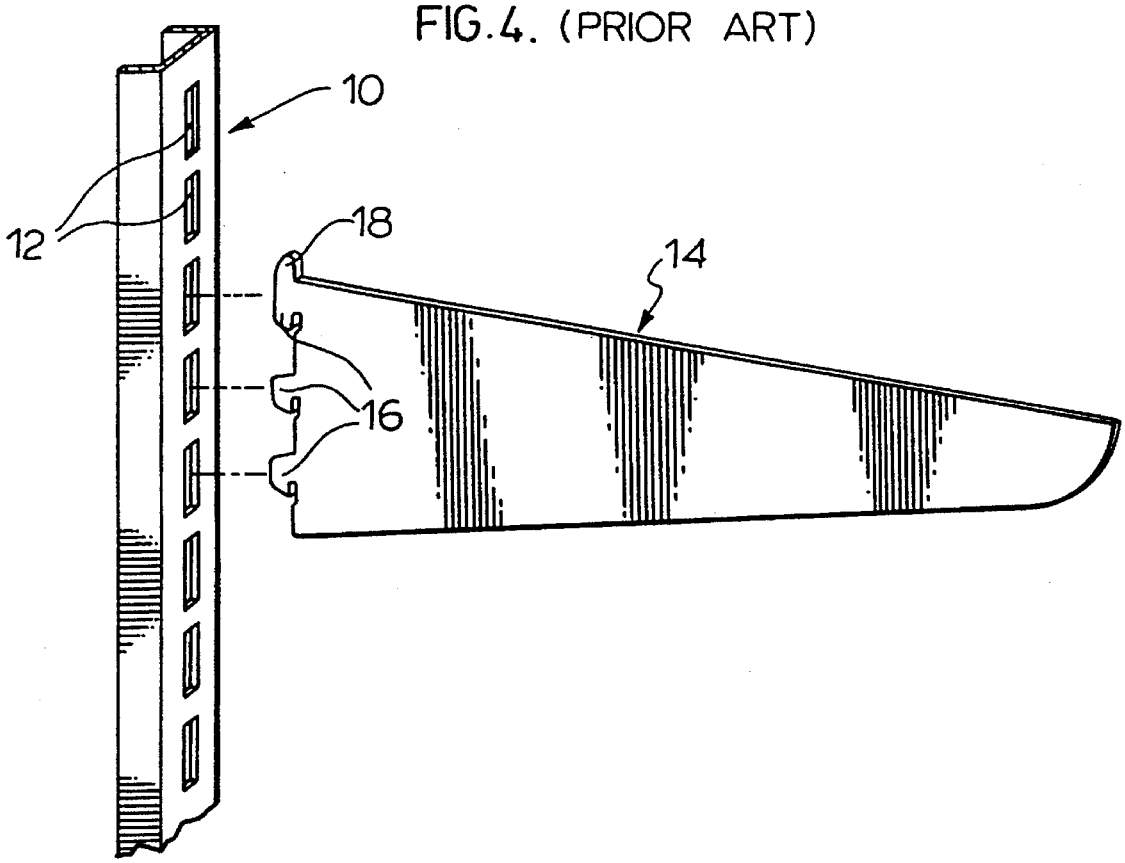
FIG. 4. (PRIOR ART)
FIG. 4 is an exploded view of a conventional slotted standard and a typical shelf bracket designed to be mounted on the standard.
Figure 5:
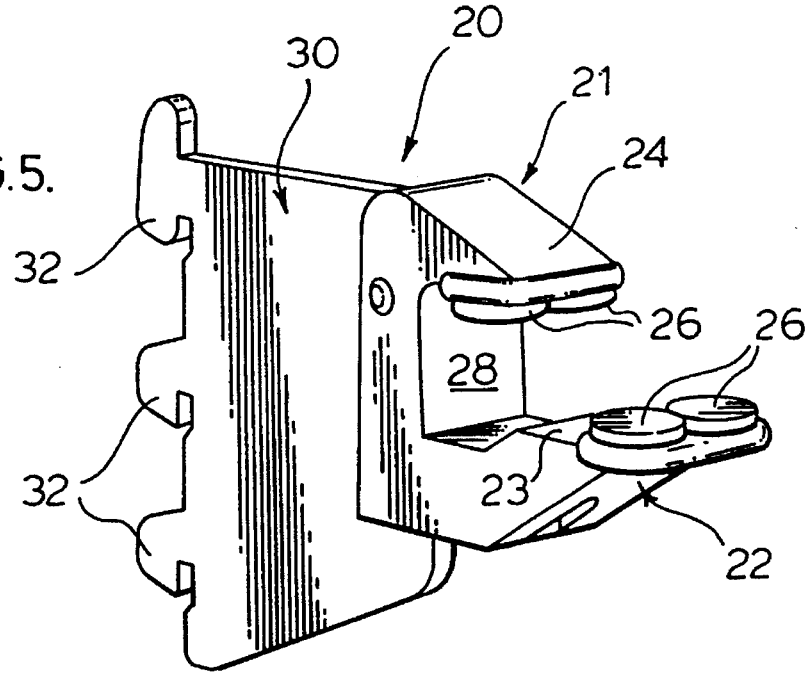
FIG. 5 is a perspective view of the adjustable shelf bracket of the invention for mounting on a slotted standard.

FIG. 4 illustrates a conventional slotted standard 10 having evenly spaced slots 12 and a typical shelf bracket 14 having hooks 16 dimensioned and spaced to engage the slots 12. The standard 10 is mounted conventionally on a vertical supporting surface 4, such as those illustrated in FIGS. 1–3. The hooks 16 are inserted into the slots 12 and the bracket 14 is pressed downwardly to lock the hooks 16 into the standard 10. The weight of a shelf (not shown) retains the bracket 14 in the slots 12 of the standard 10. As is well known, the top hook 16 may be provided with an upwardly projecting tooth 18, to ensure that the bracket 14 does not become detached from the standard 10 if upward pressure is applied. It can be seen that once the bracket 14 is mounted on the standard 10 it will seat in a fixed position and its attitude relative to the standard 10, and thus to the supporting surface 4, cannot be adjusted.

Figure 6:
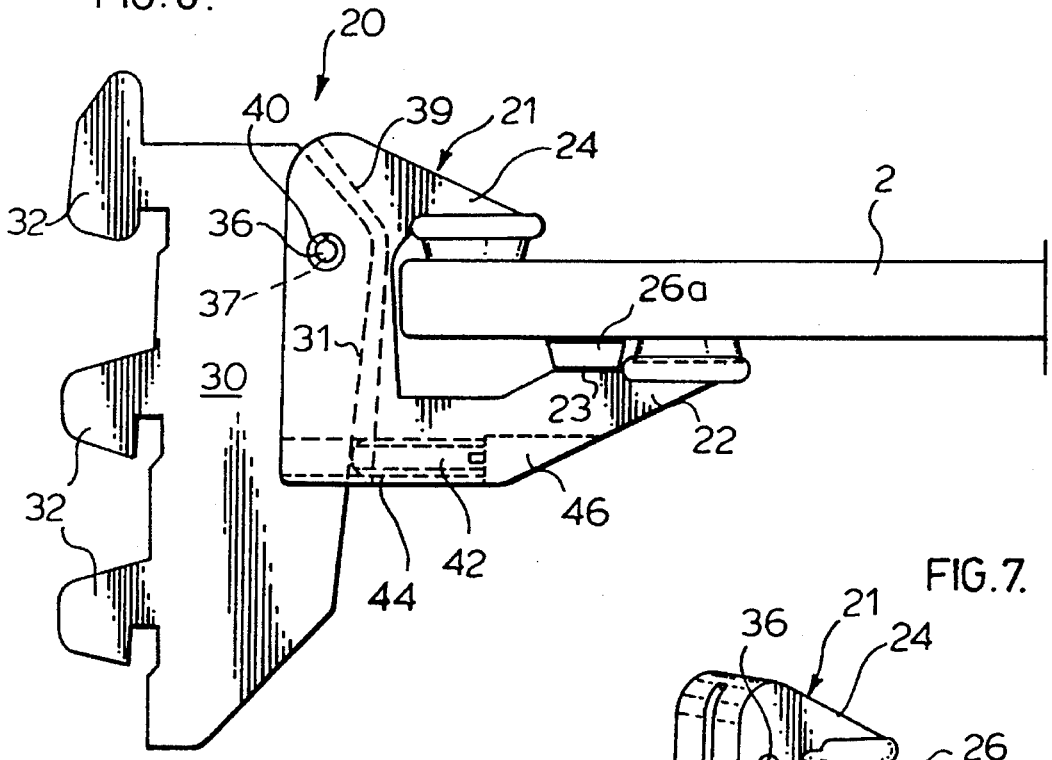
FIG. 6 is a side elevation of the shelf bracket of FIG. 5.

FIGS. 5–10 illustrate a first embodiment of the adjustable shelf bracket 20 according to the invention. In the example illustrated the bracket 20 has a clip 21 provided with means for supporting a shelf 2, comprising a lower arm 22 for supporting the bottom surface of the shelf 2 and an upper arm 24 which bears on the top surface of the shelf 2, so that the clip 21 supports the shelf 2 in cantilevered fashion, as shown in FIG. 6. Resilient pads 26 are affixed to the lower and upper arms 22, 24 to protect the shelf 2 from chipping and scratching, which is especially important in the case of glass shelves, and to provide some frictional resistance against lateral dislodgement of the shelf 2 from the clip 21. The lower and upper arms 22, 24 are fixed in substantially parallel relation by a back portion 28 of the clip 21, which is preferably cast integrally with the arms 22, 24.

In this embodiment the bracket 20 is designed to be mounted on a conventional slotted standard 10. The mounting means, in the embodiment shown a vertical mounting gusset 30, is accordingly provided with suitably spaced hooks 32 for engaging the slots 12 in the standard 10. However, in the bracket 20 of the invention the clip 21 of the bracket 20 is not fixed to the mounting gusset 30, but is pivotally suspended from the mounting gusset 30 to allow the clip 21 to pivot toward and away from the supporting surface.

Figure 7:
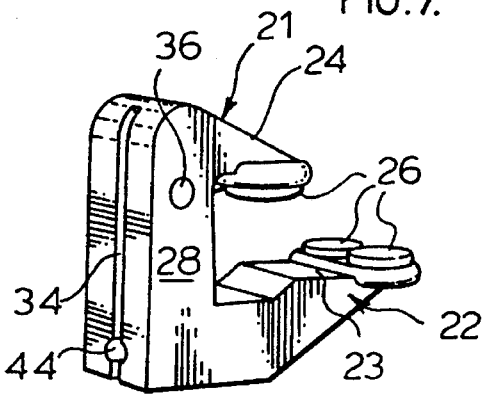
FIG. 7 is a rear perspective view of a clip for the shelf bracket of FIG. 5.
Figure 8:
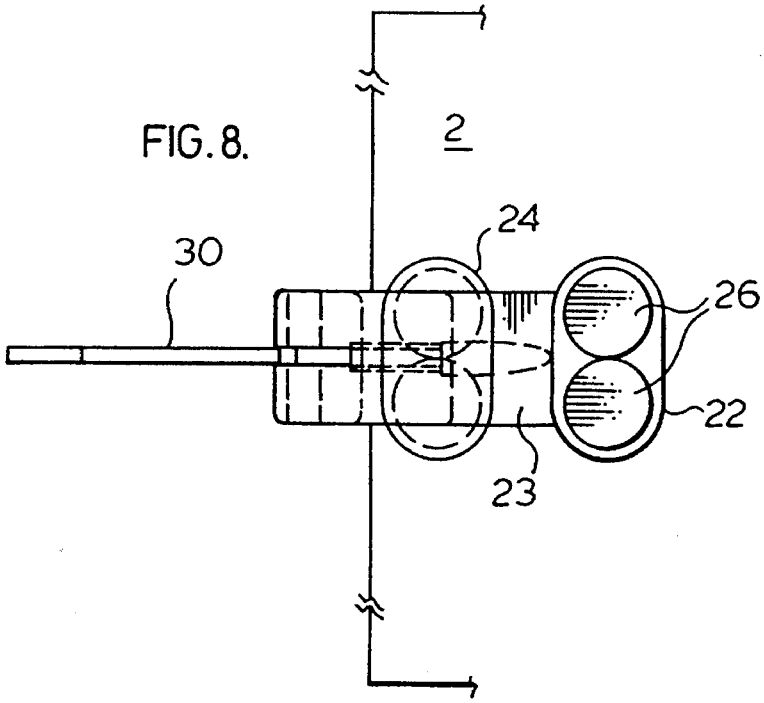
FIG. 8 is a top plan view of the shelf bracket of FIG. 5.
Figure 9:
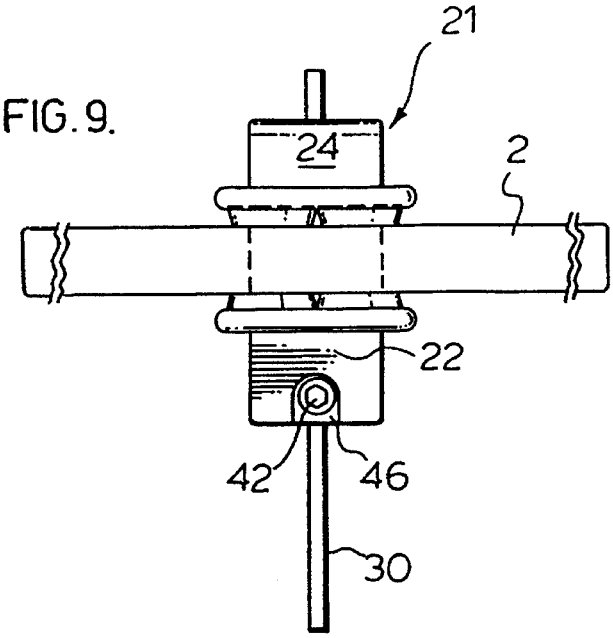
FIG. 9 is a front elevation of the shelf bracket of FIG. 5.
Figure 10:
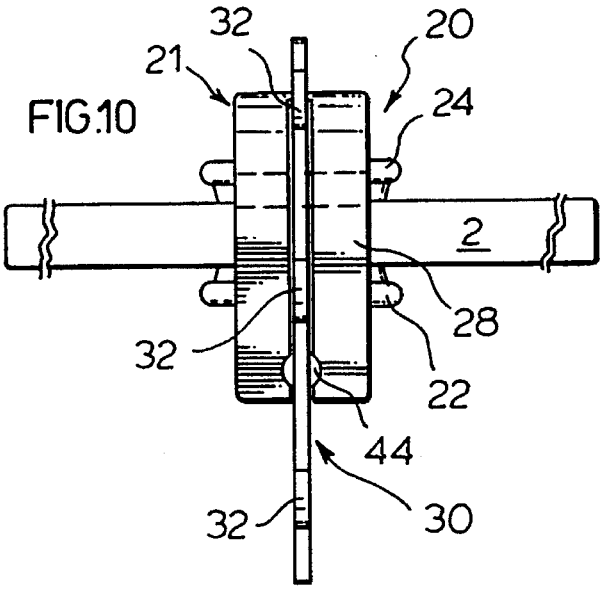
FIG. 10 is a rear elevation of the shelf bracket of FIG. 5.

As best seen in FIG. 7, the back portion 28 of the clip 21 is provided with a slot 34 just wide enough to permit the mounting gusset 30 to pivot within the slot 34. A hole 36 is disposed through the back portion 28 of the clip 21, and an upper portion of the mounting gusset 30 is provided with a complimentary hole 37, as seen in FIG. 6. The clip 21 is pivotally suspended from the mounting gusset 30 by a pin, rivet or other suitable securing means 40 inserted through the aligned holes 36, 37.

The slot 34 is deep enough that in a neutral position, in which the arms 22, 24 are at substantially right angles to the back edge of the mounting gusset 30, there is a gap between the front edge 31 of the mounting gusset 30 and the floor 39 of the slot 34, as can be seen in FIG. 6. This allows the clip 21 to pivot about an arc of travel limited by the point of contact between the front edge 31 of the mounting gusset 30 and the floor 39 of the slot 34. The arc of travel can thus be made large or small, depending solely on the size of the clearance between the front edge 31 of the mounting gusset 30 and the floor 39 of the slot 34.

Under its own weight, and especially under the weight of a shelf 2, gravity will force the clip 21 to the lower limit in the arc of travel. The clip 21 is therefore provided with adjusting means, for example a threaded adjusting screw 42 disposed through a lower end of the back portion 28. The screw 42 extends through a hole 44 through the clip 21 to the floor 39 of the slot 34, and at least a portion of the hole 44 is threaded to engage the screw 42. A recess 46 in the underside of the lower arm 22 exposes the head of the screw 42 for adjustment, while the foot of the screw 42 extends through the floor 39 of the slot 34 and bears against the front edge 31 of the mounting gusset 30.

The attitude of the clip 21 relative to the mounting gusset 30 can be adjusted simply by turning the screw 42. As the position of the screw 42 is varied the lower limit of travel of the clip 21 changes commensurately, and under the force of gravity the clip 21 assumes the attitude permitted by the adjusted lower limit, with the torque of the shelf 2 borne by the foot of the screw 42 against the front edge 31 of the mounting gusset 30.

In use, the bracket 20 is mounted to the slotted standard 10 in the manner described above. Typically a display unit will require one bracket 20 to support each end of a shelf 2, as in the display units illustrated in FIGS. 1–3. The shelf 2 is mounted into the clip 21 by tilting the front edge of the shelf 2 upwardly, inserting the rear edge between the arms 22, 24 and allowing the front edge of the shelf 2 to swing downwardly until the bottom face of the shelf 2 rests on the lower arm 22 and the top face bears against the upper arm 24.

The attitude of the shelf 2 can then be adjusted by turning the adjusting screws 42 in each clip 21 until the shelf 2 is properly levelled, both transversely and longitudinally. At each end of the shelf 2, turning the adjusting screw 42 clockwise will raise the front edge of the shelf 2, as the screw 42 recedes into the hole 44 and pushes the clip 21 away from the mounting gusset 30; conversely, turning the turning screw 42 counterclockwise will lower the front edge of the shelf 2 as the screw 42 is retracted from the hole 44 and the clip 21 pivots toward the mounting gusset 30. The attitude of the shelf 2 can be thus adjusted to be virtually exactly level every time.

In addition to the frictional resistance that the resilient pads 26 provide against lateral dislodgement of the shelf 2 from the clip 21, the invention provides a planar ledge 23 in the lower arm 22 of the clip 21, seen in FIG. 6, for firmly affixing the shelf 2 into position in the clip 21. If required, a resilient adhesive pad **26*a* can be affixed to the underside of a glass shelf 2 over the position of the ledge 23, so that when the shelf 2 is mounted into the clip 21 the pad 26*a* bears against the ledge 23 and locks the shelf 2 into place within the clip 21. If a wood shelf 2 is used the pad 26*a* could also be affixed by screws, nails etc. In either case the shelf 2 can only be removed from the clip by substantially tilting the front edge of the shelf 2 upwardly to separate the pad 26*a* from the ledge 23**.

Figure 1:
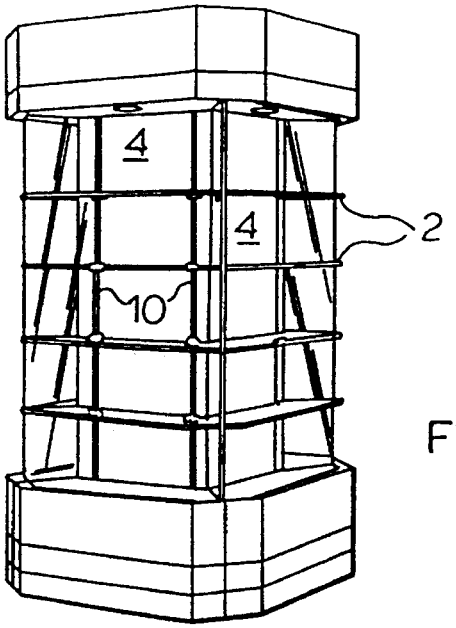
FIGS. 1, 2 and 3 are perspective views of display units having different arrangements of shelves.
Figure 2:
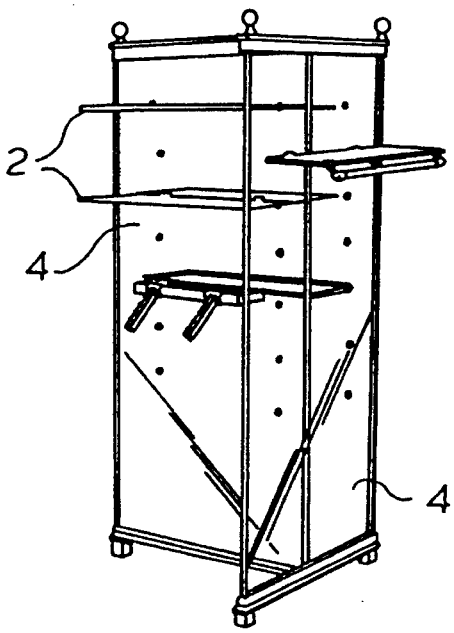

It can be seen that the shelf bracket 20 of the invention is particularly useful for decorative display units, such as those illustrated in FIGS. 1–3. In the display unit of FIG. 1 each quadrant is provided with its own set of shelves 2, separated from adjacent shelves 2 by a divider. Fine adjustments in the brackets 20 allow the ends of the shelves 2 to be properly aligned with the ends of adjacent shelves 2, with minimal effort. This feature is particularly important where adjacent shelves 2 are supporting loads of different weights, due to the different number of items or the varying mass of each item on the respective shelves, which will result in misalignment of the shelves because of the greater or lesser compressive force on the resilient pads 26. In the unit of FIG. 3 the shelves 2 can be levelled despite the oblique angle of the supporting surface 4. The shelf bracket 20 of the invention accordingly provides significantly increased versatility in the design of display units.

Figure 11:
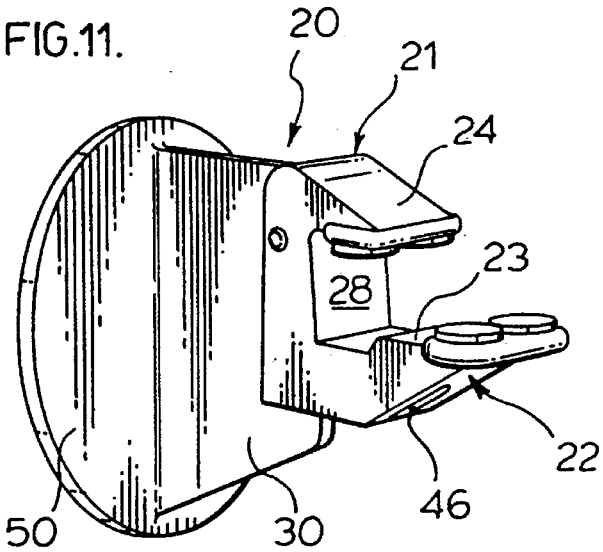
FIG. 11 is a perspective view of a further embodiment of the adjustable shelf bracket of the invention affixed to a base plate.

It will be appreciated that the bracket 20 of the invention can be adapted to be mounted on any supporting surface 4 simply by providing the mounting gusset 30 with appropriate mounting means. For example, in the embodiment of the invention illustrated in FIG. 11 the mounting gusset 30 is welded or otherwise affixed to a base plate 50, which can be mounted on the supporting surface 4 by screws, bolts, pegs, hooks or any other suitable means. This embodiment may be particularly suitable for use on a supporting surface 4 such as those in the display unit illustrated in FIG. 2, in which aesthetic considerations do not permit the use of the slotted standard 10. The gusset 30 can be made to any desired length, shorter for a flush mount or longer for mounting to a recessed standard or for leaving a space between the rear edge of the shelf 2 and the supporting surface 4. Moreover, the bracket 20 of the invention can be adapted for use with any other configuration of means for supporting a shelf, and the invention is in no way limited to the specific clip 20 described and illustrated.

Preferred embodiments of the invention having been described above by way of example, it will be apparent to those skilled in the art that certain modifications and adaptations may be made without departing from the scope of the invention as set out in the appended claims. All such modifications and adaptations are intended to fall within the invention.

I claim:

1. A bracket for supporting a shelf comprising mounting means comprising a vertical mounting gusset for mounting the bracket on a supporting surface, means for supporting a shelf provided with a vertical slot into which the mounting gusset is pivotally received, pivotally suspended from the mounting means such that the means for supporting a shelf can pivot toward and away from the supporting surface, a gap provided between a front edge of the mounting gusset and a floor of the slot, and adjusting means for maintaining the means for supporting a shelf at a desired attitude relative to the supporting surface.

2. The bracket of claim 1 in which the means for supporting a shelf is suspended by securing means extending through a hole in the means for supporting a shelf and a hole in the mounting gusset.

3. The bracket of claim 1 in which the means for supporting a shelf comprises a clip which includes an upper arm for supporting the shelf in cantilevered fashion.

4. The bracket of claim 1 in which the adjusting means comprises a threaded adjusting screw engaged to the clip and bearing against the mounting gusset.

5. The bracket of claim 4 in which the adjusting screw bears against the front edge of the mounting gusset.

6. The bracket of claim 1 in which the mounting means is provided with hooks for engaging a slotted standard.

7. The bracket of claim 1 in which the mounting means is provided with a base plate having means for mounting the bracket on a supporting surface.

8. A shelf bracket comprising mounting means comprising a vertical mounting gusset, means for supporting a shelf pivotally suspended from the mounting gusset, and adjusting means comprising a threaded adjusting screw engaged through the means for supporting a shelf for adjusting the attitude of the means for supporting a shelf bearing against the mounting gusset to define a lower limit of an arc of travel of the means for supporting a shelf.

9. The bracket of claim 8 in which the adjusting screw bears against the mounting gusset.

10. The bracket of claim 8 in which the means for supporting a shelf comprises a clip having upper and lower arms for supporting the shelf in cantilevered fashion.

11. The bracket of claim 10 in which the adjusting screw is disposed through a lower portion of the clip.

12. A bracket for supporting a shelf comprising mounting means for mounting the bracket on a supporting surface, means for supporting a shelf disposed forwardly of the mounting means, pivotally suspended from the mounting means such that the means for supporting a shelf can pivot relative to the supporting surface to change the attitude of the means for supporting a shelf, the mounting means being disposed in a vertical slot provided in the means for supporting the shelf and adjusting means bearing against the mounting means and engaged to the means for supporting a shelf, movable forwardly and rearwardly relative to the means for supporting a shelf, whereby movement of the adjusting means changes the attitude of the means for supporting a shelf.

13. The bracket of claim 12 in which the adjusting means comprises a threaded adjusting screw.

14. The bracket of claim 13 in which the adjusting screw is disposed through the clip.

15. The bracket of claim 13 in which the mounting means comprises a vertical mounting gusset.

16. The bracket of claim 15 in which the adjusting screw bears against a front edge of the mounting gusset.

17. The bracket of claim 15 in which a gap is provided between a front edge of the mounting gusset and a floor of the slot.

18. The bracket of claim 12 in which the means for supporting a shelf comprises a clip having upper and lower arms for supporting the shelf in cantilevered fashion.

19. The bracket of claim 12 in which the mounting means is provided with hooks for engaging a slotted standard.

20. The bracket of claim 12 in which the mounting means is provided with a base plate having means for mounting the bracket on the supporting surface.

* * * * *